United States Patent [19]

Meincke

[11] Patent Number: 4,907,610

[45] Date of Patent: Mar. 13, 1990

[54] CLEANING SYSTEM FOR SWIMMING POOLS AND THE LIKE

[75] Inventor: Jonathan E. Meincke, Columbia, S.C.

[73] Assignee: Crystal Pools, Inc., Irmo, S.C.

[21] Appl. No.: 348,957

[22] Filed: May 8, 1989

Related U.S. Application Data

[63] Continuation-in-part of Ser. No. 897,122, Aug. 15, 1986, Pat. No. 4,828,626.

[51] Int. Cl.[4] ..... B08B 3/02

[52] U.S. Cl. ..... 134/56 R; 134/111; 134/166 R; 134/172; 210/340

[58] Field of Search ..... 134/111, 166 R, 167 R, 134/168 R, 22.1, 22.18, 57 R, 58 R, 172; 15/1.7

[56] References Cited

U.S. PATENT DOCUMENTS

| | | | |
|---|---|---|---|
| 3,074,413 | 4/1975 | Valdez | 210/341 X |
| 3,245,420 | 4/1966 | Cherney | 134/167 R |
| 3,396,845 | 8/1968 | Bouskill | 210/341 X |
| 3,856,679 | 12/1974 | Jackson | 15/1.7 X |
| 3,972,239 | 8/1976 | Henkin et al. | 134/168 R |
| 4,188,673 | 2/1980 | Carter | 134/167 R X |
| 4,589,968 | 5/1986 | Greskovics et al. | 15/1.7 X |
| 4,592,378 | 6/1986 | Frentzel | 134/168 R X |
| 4,606,820 | 8/1986 | Rea et al. | 210/340 |
| 4,820,411 | 4/1989 | Lempio | 134/167 R X |

*Primary Examiner*—Frankie L. Stinson
*Attorney, Agent, or Firm*—Dority & Manning

[57] ABSTRACT

A cleaning system for a swimming pool which includes a mobile cleaning unit and/or stationary cleaning heads. Manual and automatic modes are included. The system is suitable for both gunnite and polymer liner pools, spas and the like. No energy is required other than that normally required for circulation of water through the conventional filtration apparatus.

23 Claims, 8 Drawing Sheets

CLEANING SYSTEM FOR SWIMMING POOLS AND THE LIKE

REFERENCE TO RELATED APPLICATION

This is a continuation-in-part of application Ser. No. 06/897,122 filed Aug. 15, 1986 now U.S. Pat. No. 4,828,626.

BACKGROUND OF THE INVENTION

The present invention relates to a cleaning system for swimming pools and the like which preferably operates automatically according to a predetermined timing sequence, and includes the possibility of employment of different types of cleaning devices.

Historically, in the cleaning of swimming pools, suction, created by water force, has been utilized both manually and automatically for the removal of dirt, leaves and other trash or debris from the shell of swimming pools and normally the bottom surface of same. Such cleaning in a manual mode is obviously time intensive and is generally considered a drawback to ownership of a pool. Particularly, in a manual situation, a cleaning head is normally mounted to an elongated handle with wheels or the like received on the head to permit rolling along the bottom of the pool. A flexible hose is connected to the cleaning head at one end and to a skimmer at an opposite end, whereby water may be drawn through the cleaning head via the skimmer by the normal circulation system. The force of the water moving through the head creates a suction at the head which lifts trash, sediment and so forth from the bottom of the pool. Trash removed is conveyed to the skimmer where it is retained in a perforated basket at the skimmer and precluded from passage to the filter system. Obviously, with such manual cleaning, an individual must move the cleaning head across the entire surface of the bottom of the pool for appropriate cleaning.

In an attempt to overcome the need for manual cleaning and thus add to the convenience and better cleanliness of the pool, various automatic cleaning systems have evolved. One such automatic cleaning system includes a cleaning device which is connectable to a source of water power which both supplies power for movement of the cleaning device, and creates suction for the removal of the trash. While automatic cleaning systems of this type are generally successful in maintaining a clean pool, certain drawbacks are present. For example, water passed through the cleaning device is utilized to power the device and must be prefiltered to avoid the introduction of trash into the movement mechanism which could clog or otherwise render inoperative the cleaning device. Significant water pressure is also required to operate this type automatic cleaning device. In fact, water pressures in a range of 35 to 50 pounds per square inch are often necessary for proper operation. Normal filters utilized for cleaning of the pool water operate at significantly lower pressures, i.e., approximately 10 to 20 pounds per square inch. Also the normal pool filter media is retained in a housing designed for low pressure operation. Dangers could thus be experienced in raising pressures in the normal filtration apparatus to the high levels mentioned above. Consequently, in order to avoid potential damage to the filter and, in fact, to avoid any possibility of filter rupture which could constitute a safety hazard, automatic cleaning systems of the type discussed above, normally bypass the pool filtration system and include a booster pump to raise the water pressures to the approximate 35 to 50 pounds per square inch range.

When utilizing a booster pump as noted above, first the additional capital expenditure for the pump is of concern. Likewise, however, the use of a booster pump in tandem with the normal pool pump requires additional energy and is, therefore, costly to the user. Still further, booster pumps of the type historically employed for the automatic cleaning system are short-lived, and require replacement every couple of years or so.

It is therefore desirable to provide a cleaning system in which water operates a cleaning device that moves along the bottom of the pool, but which does not require an extra water pump, and does not require energy in excess of that utilized in normal pool operation.

Another known type of mobile cleaning unit operates from the suction side of the pump much like the manual cleaning units described above with the exception that water being sucked through the unit also operates the motive power train to move the unit about the pool.

A further type of automatic cleaning that has historically been utilized for cleaning swimming pools is a total circulation system. Stationary cleaning heads are strategically located about the floor of the pool. Upon operation, water exiting from the heads dislodges trash from the surrounding pool area and moves such trash to an area of the pool where a drain is located, conventionally a main drain in the deep end of the pool. The trash is then removed from the pool during normal water circulation to the filtration system.

Stationary cleaning heads as being referred to, include various designs. One design includes heads that are mounted flush with the bottom wall of the pool and, upon receipt of adequate water pressure, extend upwardly from the mounting location and are rotated thereby. Water exits from the head in a circular pattern to dislodge the trash and other contaminants as noted above.

A second type head is one that is mounted in a side wall of the pool in much the same fashion as a conventional water return line, but where a nozzle is provided to direct water flow in a predetermined direction, again for dislodging trash and contaminants and forcing same to a single area of the pool.

With both of the stationary type cleaning systems discussed above, there is a possibility of lack of total coverage of the bottom of the pool. Additionally, the water force utilized to dislodge trash and contaminants from the bottom of the pool, side walls of the pool or the like, places the contaminants in suspension in the water such that less than complete cleaning is experienced. Subsequent to the cleaning cycle, the suspended matter will again settle to the bottom of the pool. Furthermore, and perhaps most importantly, cleaning systems involving the stationary cleaning heads do not address the removal of large particles of trash such as leaves, which will not pass through a main or bottom drain in the pool. Accordingly, even with the stationary cleaning heads, a pool owner is often required to utilize an additional cleaning method for removal of leaves and other large contaminants.

Stationary cleaning systems of the rotary type discussed above, have been automated to permit certain of the cleaning heads only to operate according to a determined clean cycle.

As can be seen from the above representative or available cleaning systems, no one system is without problems. The cleaning system of the present invention, however, overcomes all of the disadvantages of the prior art systems, and is not taught or suggested thereby.

SUMMARY OF THE INVENTION

It is an object of the present invention to provide an improved cleaning system for a swimming pool or the like.

Another object of the present invention is to provide an improved cleaning system for swimming pools and the like which operates on conventional pool water circulating apparatus.

Still further another object of the invention is to provide an improved cleaning system for swimming pools and the like which operates movable cleaning equipment without the necessity of a booster pump.

Yet another object of the present invention is to provide improved cleaning systems for swimming pools and the like which employ at least one movable cleaning device and stationary cleaning devices.

Another object of the present invention is to provide an automatic cleaning system for a swimming pool or the like.

Still further another object of the present invention is to provide an improved method for automatically cleaning swimming pools and the like.

Generally speaking, the cleaning system according to the present invention for cleaning a swimming pool or the like in which a water circulation system is employed including suction water lines connected between the pool and a water pump, a filter system connected to the water pump and water return lines to the pool, comprises a further filter connected to a water line in the circulation system; at least one cleaning water return line connected between a discharge side of the pump and the pool; cleaning means operatively associated with said at least one cleaning water return line at said pool for performing a cleaning function upon receipt of water from said at least one cleaning return line; and control means included in said circulation system for diverting water flow from said pool through said further filter, said pump and at least one cleaning return line while bypassing said filter system during predetermined times for instituting operation of said cleaning means and consequent cleaning of the pool.

More particularly, a cleaning system according to the present invention is preferably automatic in order to implement a cleaning cycle during times when the pool is not in use, and without the necessity of the presence of the owner of the pool. In such an automatic system, the control means could include valves in the appropriate water lines that are automatically operated according to a preset timing arrangement. In order to avoid the necessity of a booster pump for a movable cleaning unit and at the same time prefilter water being fed to the movable unit, a further or auxiliary filter is employed preferably on the suction side of the pump with the normal filter system being by-passed and with appropriate valving for directing water flow through the auxiliary filter pump and cleaning return line only during a cleaning cycle. With such an arrangement, the high pressures attendant to operation of the movable cleaning unit are not present in the normal filter, and perhaps equally as important, the filtration load on the normal filter is reduced, thus adding to the life and efficiency of the filter. The further filter employed is preferably a cartridge filter. On the suction side of the pump, pressure characteristics of the cartridge filter are not important, though when located on the discharge side of the pump, the filter should be able to withstand the high pressures.

In a most preferred embodiment, the cleaning system according to the present invention, automatically operates both movable and stationary cleaning units. For example, one cleaning return line would be operatively connected to the movable cleaning device with one or more further cleaning return lines being operatively connected to one or more banks of stationary cleaning heads strategically located about the pool. With such a combined cleaning system, not only are all of the areas of the pool including steps, spa areas, and other pool surfaces located above the bottom wall cleaned, but also all trash and debris may be removed including leaves and larger items.

While as mentioned above, operation of the stationary devices often disturb sediment to a point of placing same in suspension in the water, with a preferred arrangement of the present invention, stationary cleaning heads are employed only in the bottom of the pool at those generally planar surfaces of the pool bottom that are raised, i.e., steps, spas, etc., whereby only little of the sediment is disturbed. Likewise, stationary cleaning heads are mounted in side walls of the pool which create only limited turbulence. Furthermore, with the combined cleaning operations of the present invention, the individual components of same are preferably cyclically operated such that the movable cleaning device could precede operation of the stationary devices and thereby remove sediment from the pool bottom which otherwise could be forced into suspension.

In yet a further embodiment of the present invention, a mobile cleaner is employed which is operated from the suction side of the pump while stationary cleaning heads are operated from the cleaning return lines. With such arrangement, automatic valving may be employed to sequence the cleaning implements according to a preset schedule.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENTS

Figure 1:
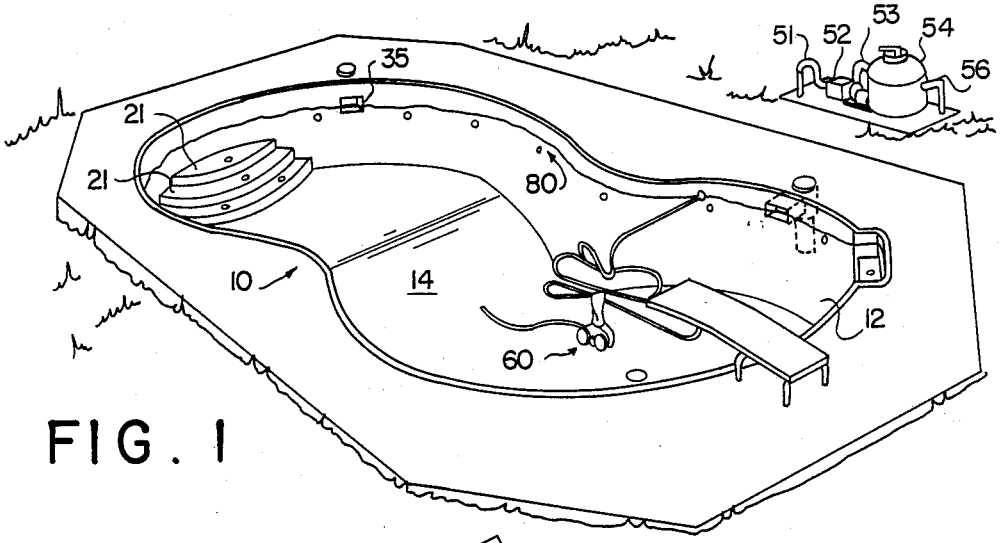
FIG. 1 is an isometric view of a typical swimming pool employing a cleaning system according to teachings of the present invention.
Figure 2:
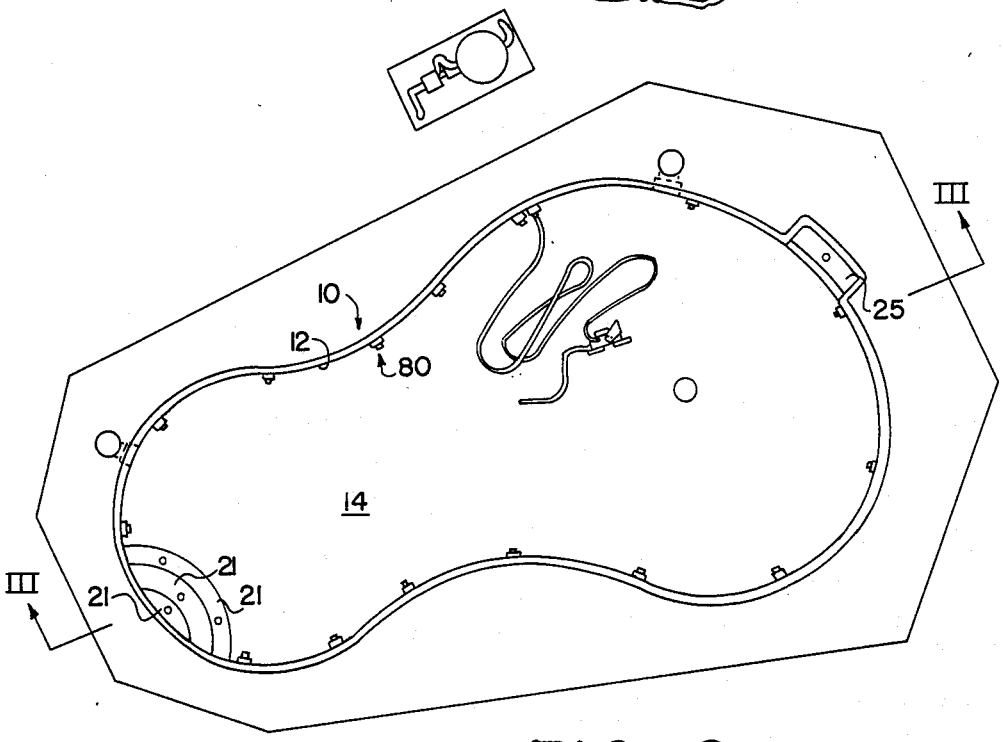
FIG. 2 is a top plan view of the pool as illustrated in FIG. 1.
Figures 3, 3A, 3B, 3C:
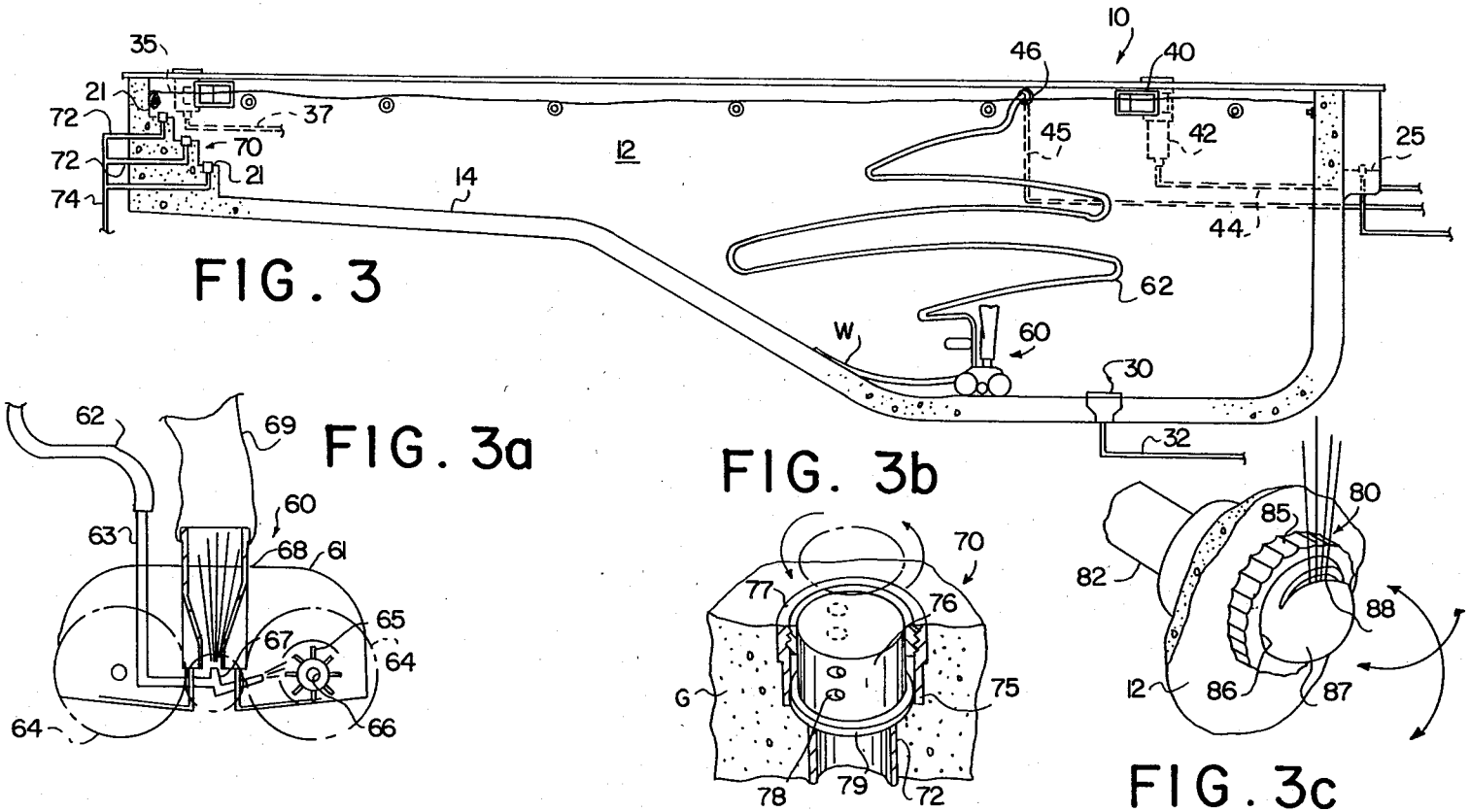
FIG. 3 is a vertical cross-sectional view taken along a line III—III of FIG. 2.
FIG. 3*a* is a schematic illustration of a movable cleaning unit for use with a cleaning system according to teachings of the present invention.
FIG. 3*b* is a schematic illustration of a flush mounted stationary cleaning head for use with a cleaning system according to teachings of the present invention.
FIG. 3*c* is a schematic illustration of a wall mounted stationary cleaning head according to teachings of the present invention.

Making reference to FIGS. 1–3*c*, preferred embodiments of the present invention will now be described in detail. A swimming pool generally indicated as 10 is illustrated in FIGS. 1–3 having side walls 12 and a bottom wall 14 with the depth of the pool 10 varying along the length of same, as indicated for example, in FIG. 3. Also as indicated, a plurality of steps 21 are illustrated at one end of pool 10 for easy access to the shallow end of the pool. Likewise, at an opposite end of pool 10 a seat 25 is provided which extends downwardly along side wall 12 for a predetermined distance and provides a location where a swimmer may sit, rest or otherwise use same as a step for climbing out of the deep end of the pool. Obviously, other areas for spas or the like may likewise be provided.

Typically, such a pool installation is a gunnite type pool, constructed of vertical and horizontal reinforcing bars (not shown) which line the pool shell and onto which a cementitious composition (gunnite) is sprayed. With the shell excavated and prior to application of the cementitious gunnite composition plumbing lines are installed which become encapsulated by the gunnite in either side walls 12 or bottom 14. For example, as illustrated, a main drain 30 is shown in bottom 14 of pool 10 with an appropriate main drain suction line 32 connected thereto and extending outwardly therefrom. An opposite end of suction line 32 would be appropriately connected to a circulating pump 52 that pulls water from the pool and through a connector line 53 feeds same to an appropriate filter system 54. Conventional water return line 56 extends from a discharge side of filter system 54 and returns water through one or more appropriate return lines 58 (see FIG. 4) to pool 10. Additionally, one or more skimmers 35 are conventionally mounted in side wall 12 of pool 10 with an appropriate suction line 37 likewise connecting the skimmer to pump 52. Skimmer 35 is intended to remove water from the surface of the pool and to appropriately likewise remove and collect leaves or other debris floating thereon. Generally, a conventional skimmer suction line 37 and main drain line 32 are brought together on the suction side of pump 52 into a common pump feed line 51 with appropriate valving to control whether water is removed from the bottom of the pool, the surface of the pool or both.

During normal operation therefore, water from pool 10 is pulled by pump 52 through main drain suction line 32 and skimmer line 37, and is then pumped to filter system 54 where the water is filtered to remove contaminants and is then returned via return lines 56, 58 to the pool. Filter system 54 conventionally is a metal or polymer structure that contains sand or diatomaceous earth filter media and operates in a general range of from about 10 to 20 pounds per square inch of pressure. Any other type filter system could, however, be employed.

According to the present invention, one or more cleaning devices may be employed. In a preferred arrangement, a movable cleaning unit such as indicated at 60, is provided which is powered by water and also utilizes water for creation of a cleaning suction. A typical movable cleaning unit of the type contemplated by the present invention and which is preferred, is a Polaris Vac Sweep produced by Alopex Industries, Inc., San Marcos, Calif. Such a unit is, in fact, schematically illustrated in FIGS. 1, 2 and 3. Mobile cleaning unit 60 receives water power via a cleaning return line 45 and connector 46 mounted in pool wall 12 to which an elongated flexible hose 62 is connected. The actual operation of same will be described in more detail hereinafter.

Movable cleaning unit 60 according to the present invention is intended to move along bottom 14 of pool 10 and along all or a portion of side walls 12 and to suction contaminants and debris therefrom. In this regard, as mentioned above, the Polaris Vac Sweep is preferred though any other mobile cleaning unit which will appropriately move under the force of water and vacuum a pool could likewise be utilized in conjunction with the cleaning system of the present invention.

Figure 3D:
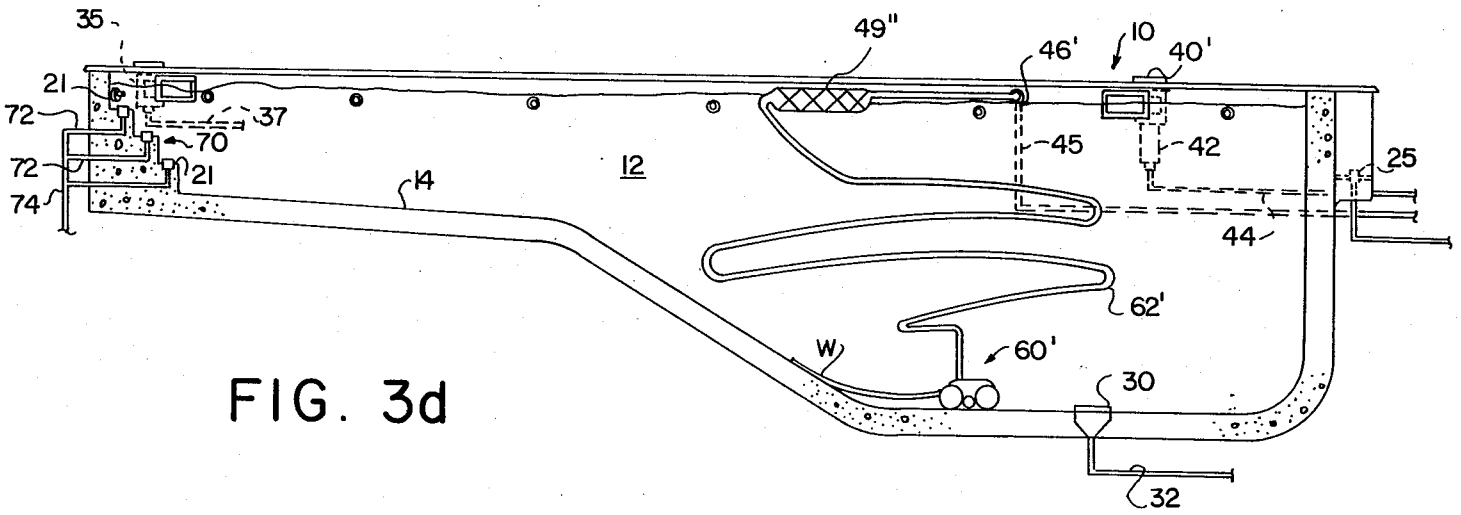
FIG. 3*d* is a vertical cross-sectional view as generally illustrated in FIG. 3, but showing a further embodiment of the invention.

In an alternative embodiment, a suction powered movable cleaning unit 60' may be provided (see FIG. 3*d*). Unlike cleaning unit 60, unit 60' is powered not by water discharge fed through a return line but rather water intake such that the device is hooked into the circulation system on the suction side of pump 52. As will be discussed in greater detail below, cleaning unit 60' may be hooked up to the suction side of the pump through various means, each requiring some filtration device to prevent at least large debris such as leaves and other debris which does not become suspended in the water from entering the pump.

The mobile cleaning unit employed, either 60 or 60', while running along bottom 14 or side walls 12 of pool 10, will not normally, as can be seen in FIG. 3, have a capability of automatically cleaning planar surfaces located above bottom 14, such as, for example, steps 21 and seat 25. Accordingly, in order to fully clean pool 20, it is preferable that the operation of the mobile unit be complemented with other cleaning means.

According to the present invention, stationary cleaning heads generally indicated as 70 (see FIG. 3*b*) may be flush mounted on the planar surfaces of steps 21 and seat 25. As illustrated in FIG. 1, 2 and 3, a plurality of stationary cleaning heads 70 constituting a bank of same are connected via individual cleaning return lines 72 to a common cleaning return line 74 such that water passing into common cleaning return line 74 will operate all stationary cleaning units 70 in communication therewith. As can be seen in FIG. 3*b*, stationary cleaning unit 70 includes a housing 75 positioned within the gunnite G of the appropriate surface and with a top of housing 75 being flush with an upper surface thereof. Located within housing 75 is a hollow body 76 having one or more tangential openings 78 therein. Upon receipt of water through return line 72, body 76 will be forced upwardly by the force of the water until a flange 79 engages a portion 77 of housing 75. Water exiting tangential slots 78 will impart a rotary motion to body 76. A circular water pattern is thus created about head 70 immediately adjacent the surface thereabout which will dislodge and force away any debris or sediment thereon thus cleaning the surface. With an appropriate number of heads 70, a set of steps 21, a seat 25 or the like may thus be cleaned.

In still a further embodiment of the present invention, in order to clean side walls 12 or areas at the juncture between side wall 12 and bottom 14, stationary cleaning heads 80 may be mounted in side wall 12. Cleaning heads 80 include a removable fitting 85 that is threadably secured to a coupling at an end of return line 82, having a central opening 86 with a global shaped element 87 residing therewithin. Global element 87 includes a slot 88 through which water may be directed. The direction of water flow through cleaning head 80 is thus determined by the position of slot 88 relative to side wall 12. In like fashion, as with stationary mounted cleaning heads 70, a plurality of cleaning heads 80 may be interconnected to form a bank of same via individual return lines 82 and common cleaning return line 84. Stationary cleaning units 80 can thus be employed to direct water across the surface of walls 12 to dislodge and remove loose algae, sediment or other debris therefrom.

Referring now to FIG. 3*a*, operation of the discharge-powered mobile cleaning unit 60 will be described. Cleaning unit 60 includes a housing 61 which rotatably supports a plurality of wheels 64. Housing 61 has a water source line 63 secured thereto which is connectable to flexible hose 62 for receipt of water from a cleaning return line 45 as described above. Water passing through housing 61 accomplishes a dual purpose. Particularly, water passing through entrance line 63 engages a turbine paddle 65 which is received on a shaft 66 to which a pair of wheels 64 are secured. Rotation of turbine 65 thus rotates the associated pair of wheels 64 and imparts movement to cleaning unit 60. At the same time, a portion of the water exits an appropriate nozzle 67 in an upward direction within a channel 68 and into a porous collector bag 69. The force of water exiting nozzle 67 creates suction therebelow as indicated by the arrows, which causes pool water thereabout to move upwardly within channel 68 carrying leaves and other debris therewith. The leaves and debris continue upward movement and are collected within collector bag 69 while the water passes through the porosities of same. Additionally, for the preferred mobile cleaning unit 60, a flexible wand W is secured thereto and is likewise moved from side-to-side by water force passing from line 63 therethrough to sweep the pool.

Alternative cleaning unit 60′ achieves the same function as unit 60 through a different means. Because 60′ is driven by suction rather than discharging water pressure, a collector bag such as 69 is not required. Instead the debris is drawn by the mobile cleaning unit up into flexible hose 62′. The suction powered cleaning unit may hook into the circulation system at a specified inlet such as 46′ of FIG. 3*d* or, optionally, may be adapted to cleaning skimmer 40′. One typical suction powered movable cleaning unit of the type contemplated by the present invention and which is preferred is the Kreepy Krauly pool cleaner produced by Kreepy Krauly U.S.A., Inc., Sunrise, Fla. The Kreepy Krauly cleaner is adapted for hook-up to a skimmer such that the skimmer may operate simultaneously with the device. Other suction powered movable cleaning units are available which hook directly to the skimmer, precluding skimming during the operation thereof, which are also within the scope of this invention.

Regardless of the method of hook-up employed, when a suction powered cleaning unit is used, some further filter must be located between the unit and the pump. When the unit is hooked directly to a skimmer such as 40′, a cartridge filter such as 42′ of FIG. 4*a* associated with that skimmer serves to prevent large debris from entering the pump. In the embodiment of FIG. 4*b*, wherein the suction powered unit is tied into the circulation system at specified inlet 46′, strainer 49′, located near the pump, achieves this function. Alternatively, a floating vacuum tank strainer 49″, as is illustrated in FIG. 3*b*, may be employed. Thus, the placement of a further filter between the suction powered cleaning unit and the pump is governed only by convenience and ease of user access.

Figure 4:
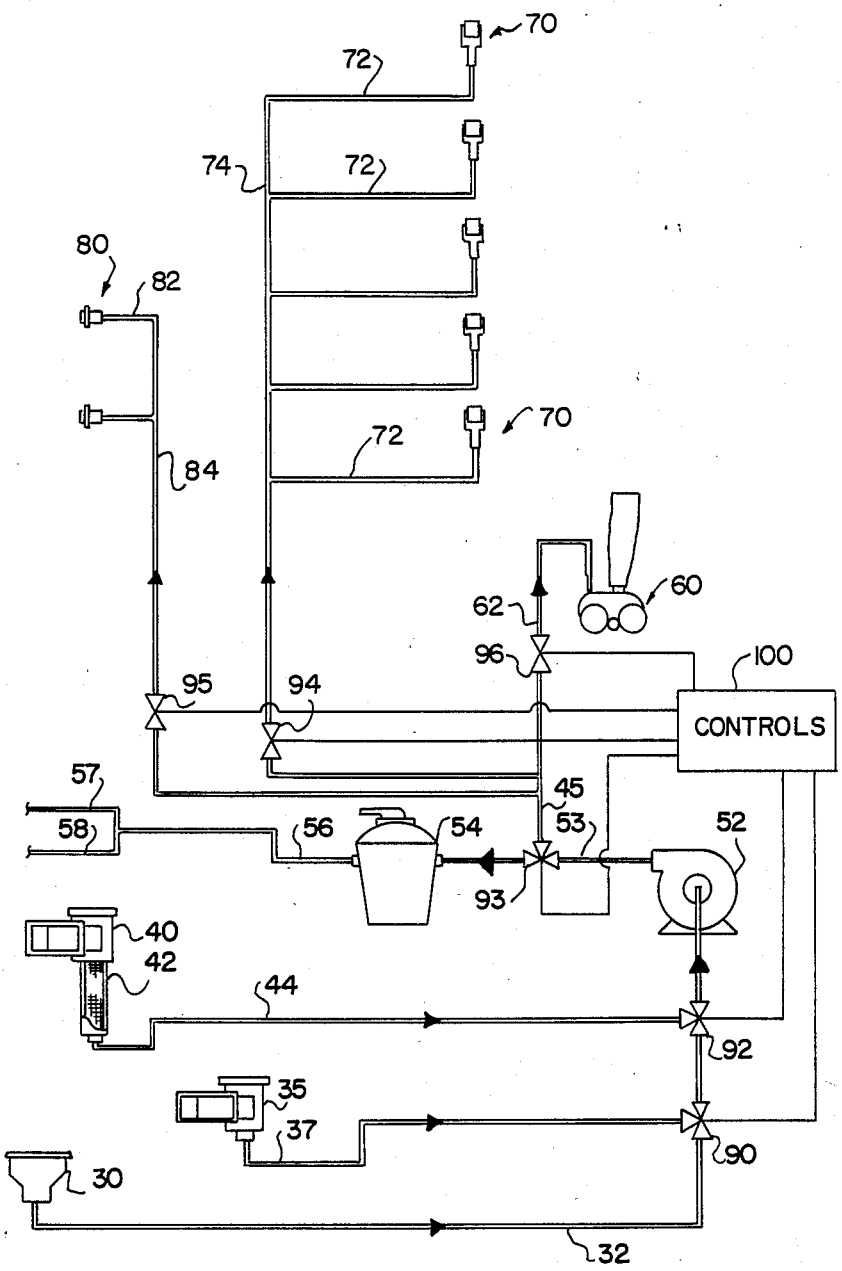
FIG. 4 is a schematic illustration of a preferred plumbing diagram for a cleaning system according to teachings of the present invention.

Referring now to FIG. 4, operation of a preferred embodiment of an overall cleaning system will be described. Under standard pool operating conditions as have been described hereinabove, pump 52 draws water from pool 10 via skimmer 35 and/or main drain 30 through the respective suction lines 37 and 32. Water then exits the discharge side of pump 52 and is forced through water line 53 to filter system 54. Within filter system 54, the water is cleaned by the filter media therein and is then returned to pool 10 via normal return lines 56, 57, 58, etc.

At such time as it is desirable to institute cleaning of pool 10, in a most preferred embodiment, a control means 100 automatically closes valve 90 and opens valve 92 which then causes water to be pulled from pool 10 through a skimmer 40 which has a further filter 42, preferably a cartridge filter, associated therewith. The water then exits further filter 42 and passes via suction line 44 to pump 52. Control means 100 also has automatically adjusted valve 93, preferably is an automatic three-port valve, to close the valve port leading to filter 54 and open the valve port in communication with cleaning return line 45. Valve 96 has also been opened by control means 100 which permits water to be pumped through return line 45 and flexible hose 62 to the discharge-powered mobile cleaning unit 60 which is connected to return line 62 as noted above. At this point, valves 94 and 95 may remain closed, and for a particular period of time mobile cleaning unit 60 moves along bottom 14 of pool 10 to appropriately remove sediment and other debris from pool 10. After a predetermined period of time, control means 100 closes valve 96 to stop operation of mobile cleaning unit 60 and opens valves 94 and/or 95 to cause the stationary mounted cleaning units 70 and/or 80 to function for a predetermined period of time.

Figure 4A:
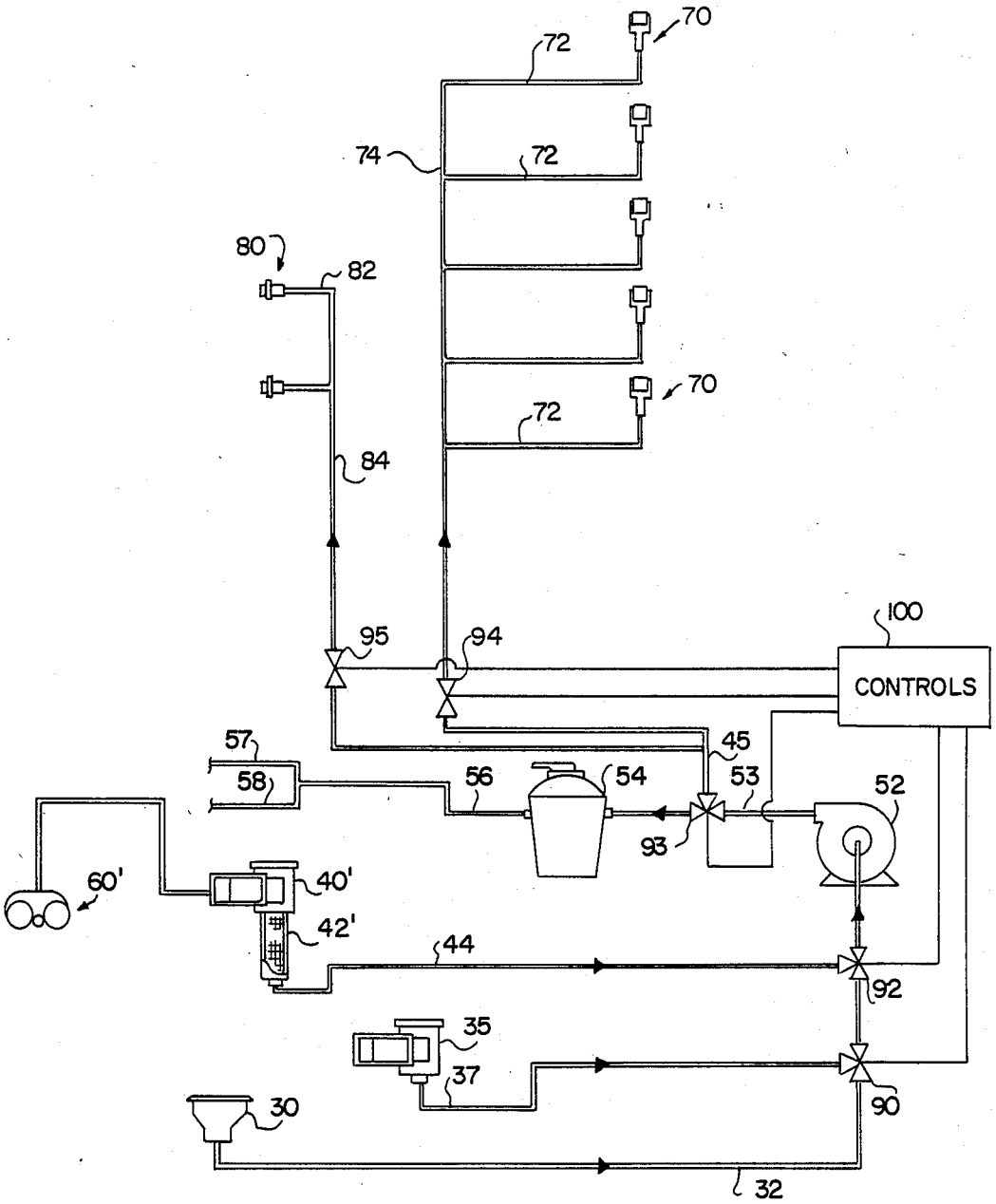
FIGS. 4*a* and 4*b* are schematic illustrations of plumbing diagrams for a cleaning system according to the present invention showing further embodiments of same.
Figure 4B:
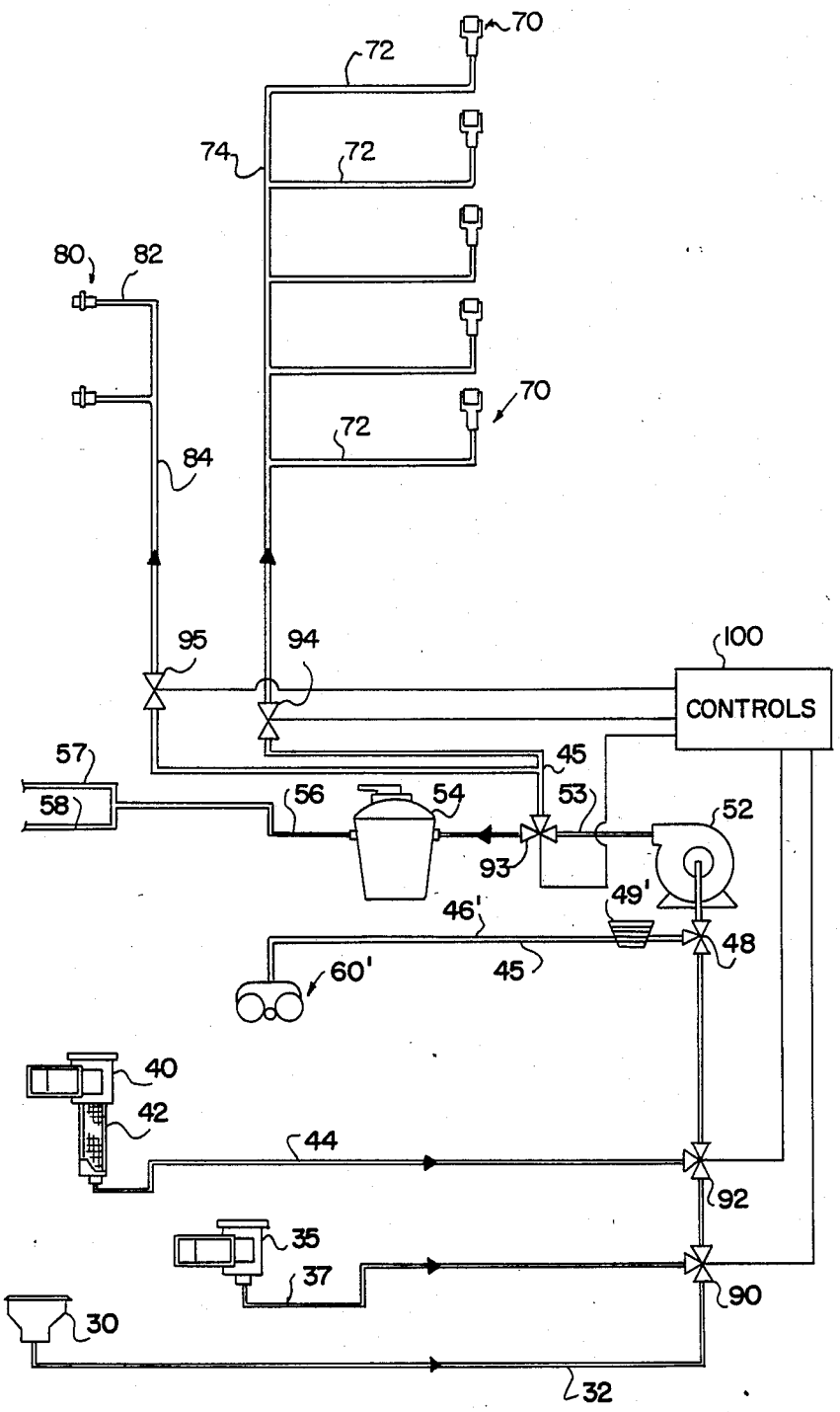

In the embodiment of FIG. 4*a*, when the control means 100 automatically closes valve 90 and opens valve 92, suction powered mobile cleaning unit 60′ is actuated causing water and debris from the floor of the pool 14 to be pulled throughskimmer 40′ and further filter 42′ associated therewith. As in the above embodiment, the water then exits further filter 42 and passes via suction line 44 to pump 52. Control means 100 also has automatically adjusted valve 93 to close the valve port leading to filter 54 and open the valve port in communication with cleaning return line 45. Valves 94 and 95 are opened to actuate the stationary mounted cleaning unit 70 and/or 80 to function. In order to achieve the time delay of the above embodiment, valves 94 and 95 may remain closed during the intake of water and debris from mobile cleaning unit 60' through feed line 44 with a direct water outlet line, not shown, pumping the discharged water directly back into the pool, or through filter 54.

With the embodiment of FIG. 4*b*, operation is the same except that an independent cleaning suction line 45 is included with a valve 48 and with a coupling 46' located in a side wall of pool 10. Flexible hose 62' is then connected between coupling 46' and mobile cleaning unit 60'.

Valve 48 is opened manually, as shown in FIG. 4*b*, or automatically by control means 100 to initiate cleaning by mobile unit 60' as described. Likewise, the water can be circulated through cleaning return lines 74, 84 or passed through filter 54 while the stationary cleaning units are not operational. Preferably while operating suction cleaner 60', the water passes through filter 54 since otherwise, the small suspended particles removed by cleaning unit 60' are just returned to the pool.

The overall cleaning cycle can include any combination of such operations, depending upon the size of the pool, the shape of the pool, or the like. In fact, while single banks of stationary cleaning units 70 and 80 are illustrated, obviously any number of banks of each or both may be employed for independent or joint operation for proper cleaning of a pool. Thereafter, control means 100 may return the overall circulation system to a standard mode as described above.

In a preferred embodiment, the various noted valves alluded to above are automatic, with actuation of each of the valves being controlled by the control means 100. Obviously, however if desirable, certain of the valves may be manual instead of automatic or include a manual override feature such that an individual may manually operate same in the event of malfunction of control means 100, or if needed to clean the pool out of a normal cleaning cycle. While the control means 100 has been illustrated schematically, such means may be any of a number of automatic systems for opening and closing the various valves according to the particular operational cycle desired. For example, electronically operated valves may be employed in conjunction with timing clocks. For example, a "JVA 2400 Jandy" valve actuator produced by Jandy Industries, a subsidiary of Savoy Corporation, San Rafael, Calif. may be employed for operation of individual three-port valves. Additionally, a "hydra 6 one" water valve produced by Parmount Leisure Industries, Scottsdale, Ariz. may likewise be employed which includes a plurality of valve ports located in a single housing with individual water lines leading to the various ports within the housing and with a timing mechanism incorporated therein for opening and/or closing the individual valve ports in a predetermined sequence.

Figure 5:
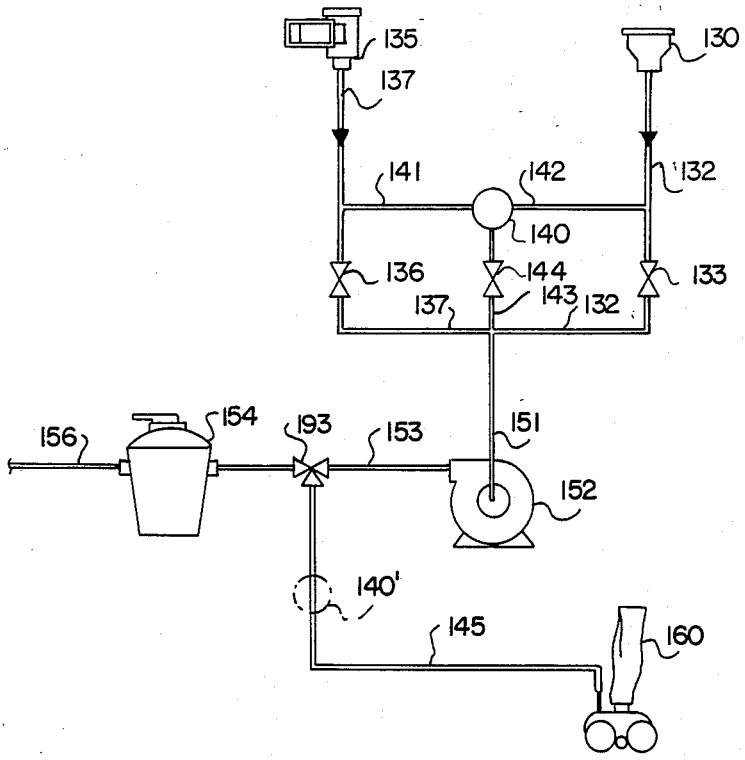
FIG. 5 is a schematic plumbing diagram of a further preferred embodiment according to teachings of the present invention.

FIG. 5 illustrates another embodiment of the present invention wherein the normal water circulation system is partially illustrated and includes a skimmer 135 and main drain 130 that communicate with a pump 152 via suction lines 137 and 132, respectively, which come together at pump line 151. Suction lines 137, 132 have valves 136, 133, respectively therein which control water flow therethrough.

As can also be seen in FIG. 5, water circulation lines 141, 142 connect suction lines 137, 132 to a further filter 140 which has a line 143 that connects with pump feed line 151. With this arrangement, water pulled from either main drain 130, 132 to a further filter 140 which line 143 that connects with pump feed line 151. With this arrangement, water pulled from either main drain 130 or skimmer 135 may by-pass cartridge 140 or may pass therethrough depending upon the operative state of valves 133, 136 and 144. With valve 144 closed and valves 133, 136 open, water is pulled from the main drain 130 and skimmer 135 through pump 152 and is discharged from pump 152 through line 153, open valve 193 into normal filter system 154 for normal water filtration. Thereafter water exits filter 154 and returns to the pool 10 via normal return line system 156. A cleaning return line 145 is connected to valve 193 located between pump 152 and filter system 154 and returns to pool 10 where it may be connected to a mobile cleaning unit 160, preferably by a flexible hose (not shown). Shown along cleaning return line 145 is a phantom representation of a further filter 140' to illustrate that the further filter can be located on the discharge side of pump 152 so long as the particular filter can withstand the attendant pressures to operation of a mobile cleaning unit 160. Although not shown, it is readily understood that a suction powered mobile cleaning unit could be hooked into the system of the FIG. 5 embodiment such as before the further filter 140. In that configuration, the valves 133 and 136 would be closed while water and debris from the bottom of the pool are pulled through further filter 140 in direct communication with pump 152 through open valve 144. Certain cartridge filters will, in fact, withstand such high pressures. In this arrangement, of course, less valving would be required than is needed where the further filter is located on the suction side of the pump.

In order to implement the cleaning cycle of the arrangement as shown in solid lines in FIG. 5, valves 133, 136 are closed and valve 144 open to route water through cartridge filter 140 to pump 152. With valve 193 closed to filter 154 and open to cleaning return line 145, no water will reach filter 154 but would pass directly to the mobile cleaning unit 160 for the operation of same. In this arrangement, high pressure operated cleaning units may be conveniently employed without the need for booster pumps and without the danger of adverse effects to the normal filter system which is not designed to operate at such pressures.

Figure 6:
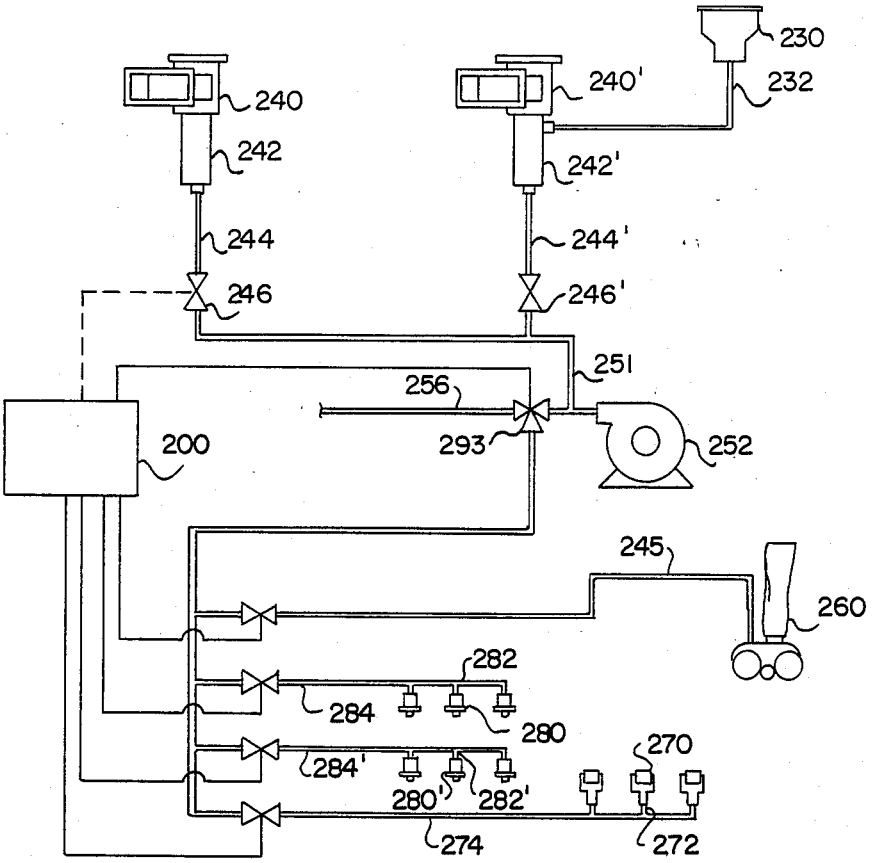
FIG. 6 is a schematic plumbing diagram of a further embodiment according to teachings of the present invention.

Referring to FIG. 6, an embodiment of the present invention is illustrated wherein in the normal circulation system, two skimmers 240, 240' have a cartridge filter 242, 242' incorporated therewith, such as might be utilized with a vinyl pool. In addition to skim filters 240, 240' a further drain 230 is illustrated which could be representative of a main drain in the bottom of the pool which is connected to filter 242'. Skimmers 240, 240' and main drain 230 are thus connected to pump 252 via circulation lines 244, 244' respectively, which join at line 251 to feed into pump 252. Appropriate valves 246, 246' are located in the circulation lines to control water flow from skimmers 240, 240'. In this embodiment, of course, all of the filtration occurs at cartridge filters 242, 242' and same may be located adjacent pump 252 instead of at skimmers 240, 240' or likewise on the discharge side of pump 252. Return lines leading from pumps 252 and connected to valve 293 are conventional return lines 256 or cleaning return lines 245, 274, 284, 284' as discussed hereinbefore.

The cartridge filters as discussed herein may by way of example be "hydro-pak" cartridge skim filters, produced by Baker Hydro, Inc., Santa Ana, Calif., which include a polyester fabric cartridge located in a housing for same below the skimmer. When dirty, the fabric cartridge which generally includes 50 square feet of surface area, may be removed, cleaned with a garden hose and returned. If located on the pressure side of a pump, then of course the filter must be able to withstand the higher pressures.

Cleaning return line 245 is connected to a mobile cleaning unit 260 while the return lines 274, 284, 284' are connected to stationary cleaning heads. According to this embodiment, two banks of wall mounted cleaning heads 280, 280' (three heads per bank) are included, each on its separate return line 284, 284'. Once again, rather than the discharge powered mobile cleaning unit 260 of this embodiment, it is to be understood that a suction powered cleaning unit may be hooked into the suction side of the present circulation system either through one of the skimmers 240 or 240' or through a specified inlet, not shown, with an independent strainer associated therewith.

During a cleaning cycle of the embodiment of FIG. 6, control means 200 would close valve 246 (at 246') if one of the skim filters is to be inoperative, and adjust valve 293 to close same to manual return line 256 and open to the cleaning return lines. Control means 200 would then sequentially open one or more of the valves 247, 281, 281' and/or 271 according to the desired cleaning cycle. In fact, with a plurality of banks of wall mounted cleaning heads 280 about a pool, banks could be sequentially opened starting from the shallow end of the pool to push all the pool debris to the deep end for removal through the main drain.

Figure 7:
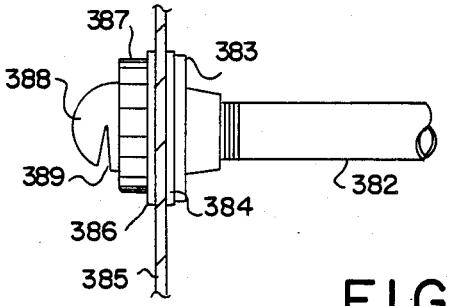
FIG. 7 is a horizontal cross-sectional view of a typical plumbing connection for a swimming pool having a polymeric liner therein.

In a vinyl pool environment, for example, as illustrated in FIG. 7, a cleaning return line 382 could, for example be utilized, having a flange 383 secured at an end of same. An annular gasket 384 would be deployed against flange 383 and would receive the pool liner 385 with an appropriate opening thereover. A further annular gasket 386 would then be placed atop liner 385 in front of gasket 384 with a proper fitting 387 received thereover. Fitting 387 would then receive a directional nozzle 388 such as has been described hereinabove, for example, with the nozzle 388 having a slit 389 therein which would determine the direction of flow of water therefrom. With this particular arrangement, a plurality of the directional nozzles could be mounted about the side walls of a vinyl pool with appropriate control means as described hereinabove connected thereto to cause sequential operation of same for a total circulation cleaning of the vinyl pool. With the total circulation arrangement, all debris, sediment and the like would thus be forced to a portion of the pool where a main drain would be located for removal of same during normal circulation of water. In the arrangement where a total circulation cleaning system only is being provided for a vinyl or other type pool, it would, of course, be necessary to locate a filter at some location other than the skimmer to permit the water carrying the debris from the cleaning cycle to be filtered prior to return to the pool unless the main drain is run through a skim filter as shown in FIG. 6. In such arrangement, of course, a normal filtration system could be utilized, or alternatively a cartridge filter could be included in the line on either side of the circulation pump.

While various embodiments of the present invention have been described hereinabove, it should be pointed out that individual features of any of the embodiments may be incorporated with other individual features of other embodiments to provide a particular cleaning system. Moreover, in any embodiment illustrated having the control means incorporated therewith, obviously such system could be a manual system. Likewise, any system shown without a control means could have an automatic control means included therewith to totally automate the system.

It will be understood, of course, that while the forms of the invention herein shown and described constitute preferred embodiments of the invention, it is not intended to illustrate all possible forms of the invention. It will also be understood that the words used are words of description rather than of limitation and that various changes may be made without departing from the spirit and scope of the invention herein disclosed.

What is claimed is:

1. An improved cleaning system for a swimming pool or the like in which a water circulation system is employed including at least one suction water line connected between said pool and a water pump, a filter system connected to said pump and at least one water return line connected between said filter and said pool, comprising:

(a) further filter means associated with a suction water line connected to the suction side of said pump for filtering at least large debris from water passing therethrough;

(b) a mobile cleaning unit connected to said suction water line having said filter means associated therewith and being operable on water being sucked through said line to move about said pool and perform a cleaning function;

(c) at least one cleaning water line connected between a discharge side of said pump and said pool;

(d) at least one stationary cleaning unit connected to said at least one cleaning return line at said pool; and (e) control means included in said circulation system for diverting water flow through said mobile cleaning unit and through said at least one cleaning return line during predetermined times for instituting operation of said cleaning units and consequent cleaning of said pool.

2. A cleaning system as defined in claim 1 wherein said further filter is associated with a skimmer mounted in a wall of said pool.

3. A cleaning system as defined in claim 2 wherein said further filter is a cartridge filter.

4. A cleaning system as defined in claim 1 wherein said further filter is a cartridge filter.

5. A cleaning system as defined in claim 1 wherein said further filter means is a strainer and during operation of said mobile cleaning unit water from the pool is allowed to pass through said filter system.

6. A cleaning system as defined in claim 1 wherein said further filter is a cartridge filter located in said system between said mobile cleaning unit and said pump.

7. A cleaning system as defined in claim 6 wherein said control means operates to bypass said filter system during operation of said mobile cleaning unit.

8. A cleaning system as defined in claim 1 wherein said control means operates to initiate operation of said stationary cleaning units and said mobile cleaning unit sequentially.

9. An improved cleaning system for a swimming pool or the like in which a water circulation system is employed which includes suction water lines connected between the pool and a suction side of a water pump, the pump connected to a water filtration system and water return lines connected between the filtration system and the pool, comprising:

(a) a further filter means located in said system before said suction side of said pump;

(b) at least one cleaning water return line located in said system with at least one stationary cleaning unit connected thereto at said pool;

(c) a mobile cleaning unit connected to one of said suction water lines before said further filter means, said mobile cleaning unit being operable to move and clean said pool by the passage of water therethrough; and (d) control means associated with said system for diverting water flow at predetermined times to operate said mobile cleaning unit and said at least one stationary cleaning unit.

10. A cleaning system as defined in claim 9 wherein a suction water line is provided for operation of said mobile cleaning unit only and being adapted for connection to the suction side of said pump during operation of said mobile cleaning unit, and a plurality of cleaning return lines are connected to the discharge side of the pump with a plurality of stationary cleaning units being connected at the pool to each of said cleaning return lines, and wherein said control means diverts water flow from said pool through said mobile cleaning unit suction line for operation of same and through said cleaning return lines, by-passing said filter system for operation of said stationary cleaning units.

11. A cleaning system as defined in claim 9 wherein said movable suction powered cleaning unit is associated with said at least one cleaning suction line at a wall of said pool, and wherein a strainer is located along a line between said mobile cleaning unit and said wall of said pool.

12. A cleaning system as defined in claim 9 wherein said further filter is associated with a skimmer.

13. A cleaning system as defined in claim 9 wherein said control means comprises valves located in said lines and means for operating said valves for diverting water flow.

14. A cleaning system as defined in claim 13 wherein said valves are timer controlled.

15. A cleaning system as defined in claim 13 wherein said control system further includes actuator means for said valves.

16. A cleaning system as defined in claim 15 wherein said actuator means is electrical.

17. A cleaning system as defined in claim 15 wherein said actuator means is hydraulic.

18. A cleaning system as defined in claim 9 wherein said at least one stationary cleaning head unit is mounted in a bottom wall of said pool, and upon receipt of water from said cleaning return line is raised from said bottom wall and is rotated with water exiting therefrom and forcing dirt, leaves and the like away from same.

19. A cleaning system as defined in claim 9 wherein said at least one stationary cleaning head is mounted in a side wall of said pool and is positioned to direct water from said cleaning return line in a predetermined direction.

20. An improved cleaning system for a swimming pool or the like in which a water circulation system is employed including suction water lines connected between the pool and a water pump, a filter system connected to the pump and water return lines connected between the filter system and the pool comprising:

(a) a mobile cleaning unit connected to one of said cleaning suction lines and being operable to move about and clean said pool by the passage of water therethrough;

(c) a further filter means located between said mobile cleaning unit and said pump for removing at least nonsuspendable debris from water passing therethrough;

(d) a plurality of cleaning return lines connected between said pool and said system on the pressure side of said pump;

(e) a plurality of stationary cleaning units located in said pool and being connected to said cleaning return lines, said stationary cleaning units being operable to perform a cleaning function upon receipt of water from said cleaning return line to which they are connected; and (f) control means associated with said system for diverting water flow through said suction cleaning line and said cleaning return lines at predetermined times to affect cleaning of the pool.

21. A cleaning system as defined in claim 20 wherein said further filter is a cartridge filter.

22. A cleaning system as defined in claim 20 wherein said further filter is a strainer.

23. A cleaning system as defined in claim 20 wherein said cleaning return lines are connected to the pressure side of the pump whereby when water is diverted therethrough, the filter system is by-passed.

* * * * *

US004907610B1

REEXAMINATION CERTIFICATE (3343rd)

United States Patent [19] [11] B1 4,907,610

Meincke [45] Certificate Issued Oct. 7, 1997

[54] CLEANING SYSTEM FOR SWIMMING POOLS AND THE LIKE

[75] Inventor: Jonathan E. Meincke, Columbia, S.C.

[73] Assignee: Crystal Pools Inc., Irmo, S.C.

Reexamination Request:
No. 90/004,406, Oct. 7, 1996

Reexamination Certificate for:

| | |
|---|---|
| Patent No.: | **4,907,610** |
| Issued: | **Mar. 13, 1990** |
| Appl. No.: | **348,957** |
| Filed: | **May 8, 1989** |

Related U.S. Application Data

[63] Continuation-in-part of Ser. No. 897,122, Aug. 15, 1986, Pat. No. 4,828,626.

[51] Int. Cl.[6] ..... B08B 3/02

[52] U.S. Cl. ..... 134/56 R; 134/111; 134/166 R; 134/172; 210/340

[58] Field of Search ..... 134/111, 166 R, 134/167 R, 168 R, 56 R, 57 R, 58 R, 22.1, 22.18, 172; 15/1.7; 210/340

[56] References Cited

U.S. PATENT DOCUMENTS

| | | |
|---|---|---|
| 3,146,783 | 9/1964 | Aultman . |
| 3,449,772 | 6/1969 | Werner . |
| 3,512,540 | 5/1970 | Hughes . |
| 4,086,933 | 5/1978 | Pansini . |
| 4,114,206 | 9/1978 | Franc . |
| 4,193,818 | 3/1980 | Young et al. . |
| 4,193,870 | 3/1980 | Goodin . |
| 4,212,088 | 7/1980 | Goettl et al. . |
| 4,592,379 | 6/1986 | Goettl . |
| 4,832,838 | 5/1989 | Stone . |

OTHER PUBLICATIONS

Cir–U–Vac System Publication, marketed around 1987–early 1988.

*Primary Examiner*—Frankie L. Stinson

[57] ABSTRACT

A cleaning system for a swimming pool which includes a mobile cleaning unit and/or stationary cleaning heads. Manual and automatic modes are included. The system is suitable for both gunnite and polymer liner pools, spas and the like. No energy is required other than that normally required for circulation of water through the conventional filtration apparatus.

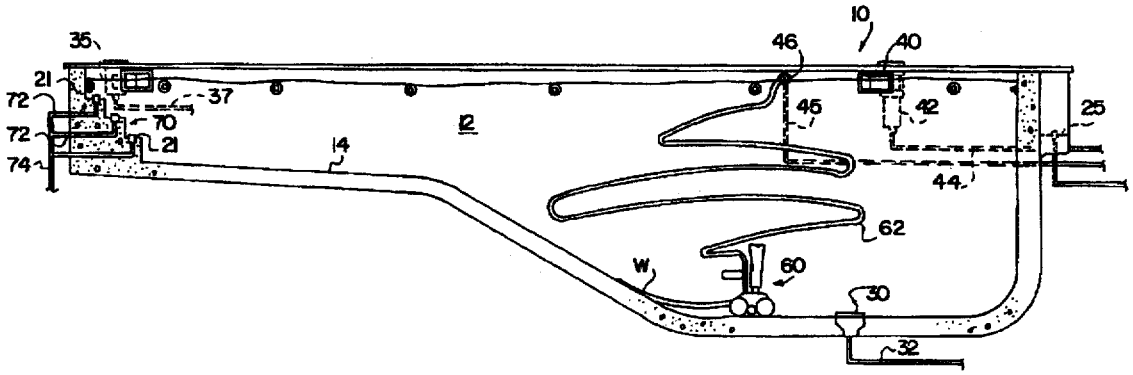

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–23 is confirmed.

* * * * *